US012680396B2

(12) United States Patent
Chen et al.

(10) Patent No.: US 12,680,396 B2
(45) Date of Patent: Jul. 14, 2026

(54) REAL-TIME WEAR DETECTION OF A DRILL BIT DOWNHOLE IN A WELLBORE

(71) Applicant: Halliburton Energy Services, Inc., Houston, TX (US)

(72) Inventors: Yuanyan Chen, Houston, TX (US); Ketan C. Bhaidasna, Houston, TX (US); Siyang Song, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/933,666

(22) Filed: Oct. 31, 2024

(65) Prior Publication Data

US 2026/0117597 A1 Apr. 30, 2026

(51) Int. Cl.
*E21B 12/02* (2006.01)
*E21B 44/04* (2006.01)

(52) U.S. Cl.
CPC ..... *E21B 12/02* (2013.01); *E21B 44/04* (2013.01)

(58) Field of Classification Search
CPC ..... E21B 44/00; E21B 44/02; E21B 44/04; E21B 12/02
See application file for complete search history.

(56) References Cited

U.S. PATENT DOCUMENTS

2009/0250264 A1* 10/2009 Dupriest ..... E21B 45/00 702/9
2015/0275648 A1 10/2015 Wang et al.
2018/0023382 A1 1/2018 Ringer et al.
2020/0284099 A1* 9/2020 Hassani ..... E21B 44/00
2021/0363871 A1 11/2021 Samuel et al.
2022/0316328 A1* 10/2022 Srivastava ..... E21B 49/003
2023/0272682 A1* 8/2023 Stewart ..... E21B 44/00 175/25

FOREIGN PATENT DOCUMENTS

EP 0551134 A1 7/1993
WO 2023204852 A1 10/2023

OTHER PUBLICATIONS

International Patent Application No. PCT/US2024/056890, International Search Report and Written Opinion Jul. 18, 2025, 9 pages.

(Continued)

*Primary Examiner* — Kristyn A Hall
(74) *Attorney, Agent, or Firm* — Kilpatrick Townsend & Stockton LLP

(57) ABSTRACT

Certain aspects and features relate to a system that can perform real-time wear detection of a drill bit downhole in a wellbore. For example, the system can measure, during a drilling operation for drilling of the wellbore, at least one drilling operational parameter using one or more sensors positioned at a surface of the wellbore. The system can generate, during the drilling operation and based on the at least one drilling operational parameter, a bit-rock signature of at-bit parameters for a drill bit used for drilling the wellbore. The system can determine, during the drilling operation and based on the at-bit parameters of the bit-rock signature meeting one or more predefined conditions, a bit condition of the drill bit. The system can output the drill bit for use in modifying the drilling of the wellbore.

20 Claims, 7 Drawing Sheets

(56) References Cited

OTHER PUBLICATIONS

Unpublished U.S. Appl. No. 18/731,650, filed Jun. 3, 2024. In accordance with the Waiver of the Copy Requirements in 37 CFR 1.98 for Cited Pending U.S. Patent Applications, 1287 O.G. 163 (Oct. 19, 2004).
Unpublished U.S. Appl. No. 63/516,593, filed Jul. 31, 2023. In accordance with the Waiver of the Copy Requirements in 37 CFR 1.98 for Cited Pending U.S. Patent Applications, 1287 O.G. 163 (Oct. 19, 2004).
Gidh et al., "Artificial Neural Network Drilling Parameter Optimization System Improves ROP by Predicting/Managing Bit Wear", Paper presented at the SPE Intelligent Energy International, Utrecht, The Netherlands. SPE-149801-MS, Mar. 2012, 13 pages.
Liu et al., "Real-Time Bit Wear Monitoring and Prediction Using Surface Mechanics Data Analytics: A Step Toward Digitization Through Agile Developmen", Paper presented at the IADC/SPE Drilling Conference and Exhibition, Fort Worth, Texas, USA. SPE-189602-MS, Mar. 2018, 9 pages.

* cited by examiner

REAL-TIME WEAR DETECTION OF A DRILL BIT DOWNHOLE IN A WELLBORE

TECHNICAL FIELD

The present disclosure relates generally to wellbore drilling operations and, more particularly (although not necessarily exclusively), to real-time wear detection of drill bits downhole in a wellbore.

BACKGROUND

Hydrocarbons, such as oil and gas, can be extracted from subterranean formations that may be located onshore or offshore. Hydrocarbons can be extracted through a wellbore formed in a subterranean formation. Wellbore operations for extracting hydrocarbons can include drilling operations, in which a wellbore can be drilled with drill string. In some cases, the drill string may be thousands of feet long. During the drilling process, several operational parameters may affect the rate of penetration (ROP), such as surface weight on bit (WOB), rotations per minute (RPM), flow rate, etc. Drilling operational parameters may be monitored during drilling operations to ensure that the wellbore is being drilled in a particular direction within safety protocols.

DETAILED DESCRIPTION

Figure 1:
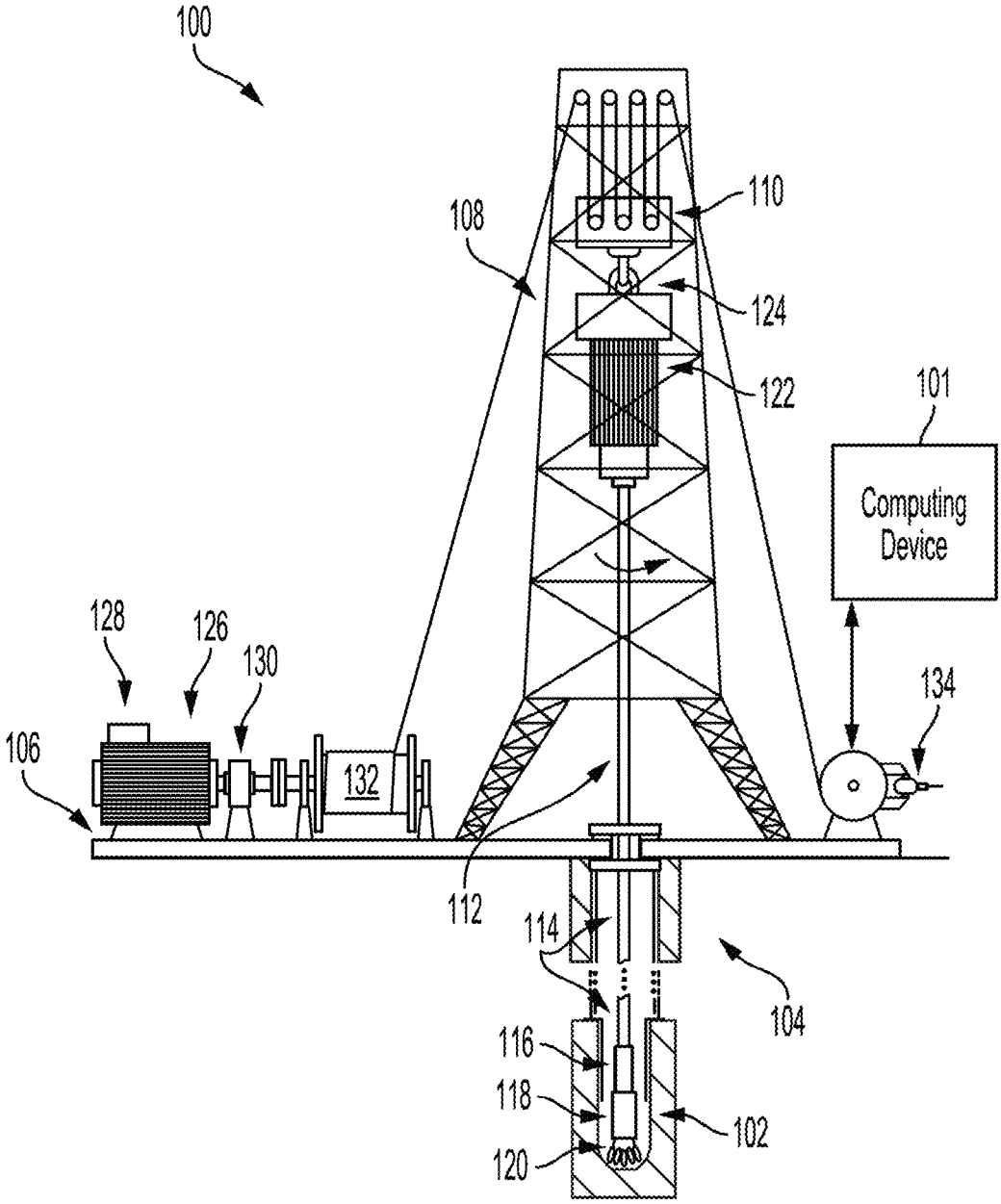
FIG. 1 is a cross-sectional view of a well system used to form a wellbore in a subterranean formation, according to one example of the present disclosure.

Certain aspects and examples of the present disclosure relate to a system that can use surface data to perform real-time wear detection of a drill bit that is downhole drilling a wellbore. The real-time wear detection can be determined from a bit-rock interface signature that is determined based on the surface data. For example, measurements made at the surface of the wellbore can be used to estimate downhole at-bit parameters, such as at-bit weight on bit (WOB), at-bit torque on bit (TOB), depth of cut, and more of the bit-rock signature at a particular point in time (e.g., when the measurements were taken). The measurements at the surface can include surface WOB (e.g., hook weight), rotations per minute (RPM) of a drill string, drilling fluid flow rate, and any other suitable measurement at surface. The at-bit parameters of the bit-rock signature can be used to determine the real-time bit condition of the drill bit. Drill bits that are determined to be sharp or workable may continue performing drilling operations. Or, the bit condition may indicate that the drill bit may need to be cleaned, and thus the flow rate of drilling fluid downhole may be increased to flush the drill bit. In other examples, the bit condition may indicate that the drill bit is dull or damaged. This may lead to low rate of penetration (ROP) of the drill bit, damage to downhole tools, inefficient drilling, and so forth. To prevent such issues, in some examples, the system can alert a wellbore operator so that the drilling operation can be terminated, halted, or adjusted. Additionally or alternatively, the system may automatically terminate or adjust the drilling operation based on the bit condition.

Conventional techniques for identifying bit wear may be inaccurate due to distances between the drill bit and surface, which may be up to thousands of feet. For instance, limited telemetry bandwidth can constrain the availability of downhole data, making it difficult or impossible to accurately assess condition of the drill bit. Moreover, there may be no direct measurements available to indicate condition of the drill bit, further complicating the assessment process. Consequently, detecting bit condition can be challenging, particularly when making decisions about tripping (e.g., length of time for a drilling operation). If a trip is terminated too early and a healthy drill bit is pulled from the wellbore, the tripping time may not be justified by the economics of using a new bit. Conversely, if the trip is too late, additional operating costs may be significant due to inefficient drilling and increased risk of damage to downhole equipment.

In contrast, embodiments described herein involve real-time wear detection of drill bits using only surface data, eliminating the need for advanced downhole tools. Embodiments described herein can be universally applied to various types of drilling bits, including roller cone bits, polycrystalline diamond compact (PDC) bits, Kymera hybrid bits, or any other type of drill bit used downhole. The real-time wear detection described herein may also be applied to both onshore and offshore drilling environments. By using only surface data, embodiments described herein can reduce costs, minimize downtime, and reduce damage in drilling operations.

For instance, as drill bits wear down, the ROP can decrease. Decreased ROP can result in taking longer to drill the same distance using a new or less worn drill bit. This slowdown can translate directly into increased operational costs, not only due to the need for more frequent bit replacements, but also because of the associated downtime involved in such bit replacements. In contrast, embodiments described herein can more quickly identify worn bits, preventing drilling operations from occurring at decreased ROP. Moreover, worn drill bits may result in an imbalance of forces when the drill bit engages with a subterranean formation. The imbalance can induce vibrations in the drill string, which may significantly impact the performance and longevity of drilling tools. The vibrations can compromise the accuracy of sensors and, in severe cases, may cause damage to the tools themselves. Thus, quickly and accurately detecting bit wear according to techniques described herein can reduce vibration and damage to downhole tools. Additionally, the real-time wear detection described herein can detect various types of bit failure, including accumulated wear and sudden failure.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a cross-sectional view of a well system 100 used to form a wellbore 102 in a subterranean formation 104, according to one example of the present disclosure. The wellbore 102 can be drilled through one or more layers of the subterranean formation 104 for extracting natural resources such as hydrocarbons therefrom. The well system 100 can include an operating rig, which can include a drilling platform 106 that can support a derrick 108 having a traveling block 110 for raising and lowering a drill string 112. The raising and lowering of the drill string 112 may be controlled by a draw-works electrical drive 126, which can include a direct current (DC) motor 128, a gearbox 130, and a winch 132.

The drill string 112 may include multiple drill pipes 114, a heavy weight drill pipe (HWDP) 116, one or more collars 118, and a drill bit 120. The drill bit 120 can be driven by a downhole motor or rotation of the drill string 112, which in some examples may be caused by a geared top-drive drilling motor 122. As the drill bit 120 rotates, the drill bit 120 can create the wellbore 102 that passes through the subterranean formation 104. Drilling fluid may be circulated downhole to transport cuttings from the wellbore 102 and to aid in maintaining integrity of the wellbore 102. The weight of the drill string 112 and downhole tools, including the drill bit 120, may be supported by a hook 124. A sensor 134 can be coupled to the hook 124 and can measure forces on the hook 124. The sensor 134 may, in some examples, measure additional or alternative drilling operational parameters of the drilling operation, such surface weight on bit (WOB), flow rate of drilling fluid circulating downhole, rotations of the drill string 112 per unit of time (such as rotations per minute (RPM)), and the like.

Figure 2:
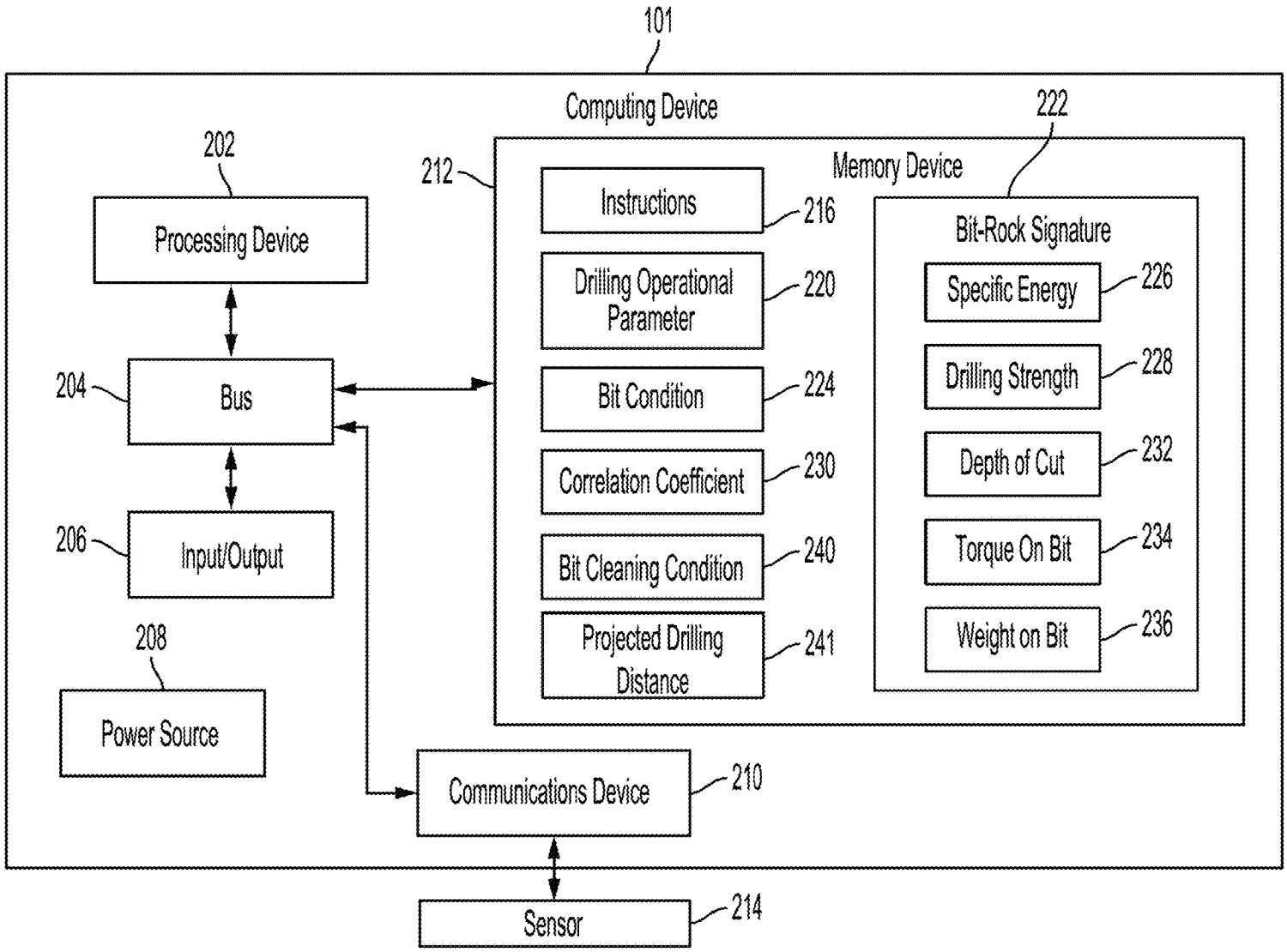
FIG. 2 is a block diagram of a computing system used to perform real-time bit wear detection of a drilling system, according to one example of the present disclosure.

A computing device 101 at the surface of the wellbore 102 may be coupled to the sensor 134 to measure the drilling operational parameters. The computing device 101 can use the drilling operational parameters measured at the surface of the wellbore 102 to determine a bit condition of the drill bit 120 in real time. An example of the computing device 101 is depicted in FIG. 2, which is described in further detail below. The computing device 101 can output the bit condition to a wellbore operator, such as in an alert notifying the wellbore operator that the drill bit 120 has suddenly failed. In some examples, the computing device 101 may automatically adjust parameters of the drilling operation based on the determined bit condition. For example, the computing device 101 may automatically terminate or halt the drilling operation, adjust the surface WOB or ROP, adjust flow rate of drilling fluid circulating downhole, or may perform any other suitable adjustment to the drilling operation.

FIG. 2 is a block diagram of a computing device 101 used to perform real-time bit wear detection of a drilling system, according to one example of the present disclosure. The components shown in FIG. 2 may be integrated into a single structure, such as within a single housing of a computing device. Alternatively, the components shown in FIG. 2 can be distributed from one another and in electrical communication with each other.

The computing device 101 can include a processing device 202, a memory device 212, and a bus 204. The memory device 212 can include instructions 216 that are executable by the processing device 202. For example, the processing device 202 can execute the instructions 216 to determine bit condition 224 of a downhole drill bit that is drilling a wellbore. The processing device 202 can include one processing device or multiple processing devices or cores. Non-limiting examples of the processing device 202 include a Field-Programmable Gate Array (FPGA), an application-specific integrated circuit (ASIC), a microprocessor, or a combination of these.

The processing device 202 can be communicatively coupled to the memory device 212 via the bus 204. The non-volatile memory device 212 may include any type of memory device that retains stored information when powered off. Non-limiting examples of the memory device 212 may include electrically erasable programmable read-only memory (EEPROM), flash memory, or any other type of non-volatile memory. In some examples, at least part of the memory 321 can include a medium (e.g., a non-transitory computer-readable medium) from which the processing device 202 can read instructions 216. A non-transitory computer-readable medium can include electronic, optical, magnetic, or other storage devices capable of providing the processing device 202 with the non-transitory computer-readable instructions or other program code. Non-limiting examples of a non-transitory computer-readable medium include (but are not limited to) magnetic disk(s), memory chip(s), ROM, RAM, an ASIC, a configured processor, optical storage, or any other medium from which a computer processor can read instructions 216. The instructions 216 can include processor-specific instructions generated by a compiler or an interpreter from code written in any suitable computer-programming language, including, for example, C, C++, C#, etc.

The computing device 101 can also include a power source 208 that can power various components of the computing device 101, such as the processing device 202, the memory device 212, and the communications device 210. The power source 208 can be in electrical communication with those components, such as the communications device 210, even though this is not shown in FIG. 2 for simplicity. In some examples, the power source 208 can include a battery or an electrical cable (e.g., a wireline). The communications device 210 may be coupled to a sensor 214, such as the sensor 134 of FIG. 1. The sensor 214 may measure drilling operational parameters 220 at a surface of a wellbore.

The computing device 101 may additionally include an input/output interface 206. The input/output interface 206 can connect to a keyboard, point device, display, and other computer input/output devices. An operator may provide input using the input/output interface 206. Bit conditions may be displayed to an operator of a drilling operation through a display that is connected to or is part of the input/output interface 206. The displayed values can be observed by the operator, who can make adjustments to the drilling operation based on the displayed values. Additionally or alternatively, the computing device 101 may generate and transmit signals (e.g., via the input/output interface 206 or the communications device 210) that can control adjustments to the drilling operation based on the bit condition 224. For example, control signals can be sent to fluid pumps to adjust flow rate of drilling fluid pumped into the wellbore, to steering devices to cause adjustments to the steering of the drill bit 120 downhole, to control devices controlling surface weight on bit of the drill string 112 or surface rotations per minute (RPMs) of the drill string 112, and the like.

Figure 4:
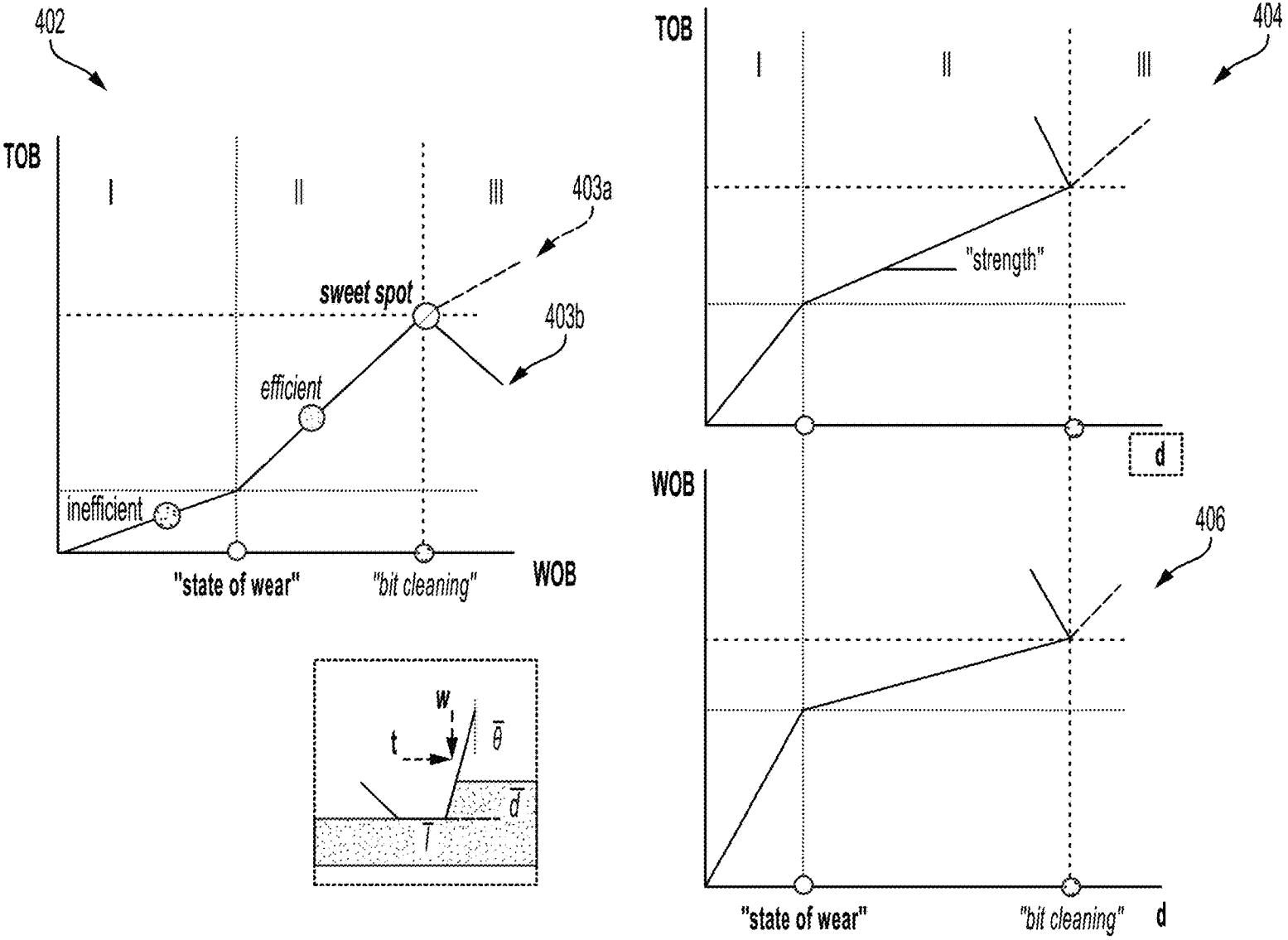
FIG. 4 depicts graphs illustrating a bit-rock signature of a drilling system, according to one example of the present disclosure.

The computing device 101 can measure or acquire the drilling operational parameters 220 from the sensor 214. Although only one sensor 214 is depicted in FIG. 2, in other examples any number of sensors at any position above the surface of the wellbore 102 can be used to measure or acquire drilling operational parameters 220. The processing device 202 can execute the instructions 216 to determine bit condition 224 of a drill bit downhole based on one or more drilling operational parameters 220 that are collected from one or more sensors 214. For example, the processing device 202 can first determine a bit-rock signature 222 based on the drilling operational parameters 220. The bit-rock signature 222 may be the drilling response from performing the drilling operation. The bit-rock signature 222 can include at-bit parameters such as a torque on bit (TOB) 234-weight on bit (WOB) 236-depth of cut 232 (t-w-d) space. Examples of the t-w-d space are depicted in FIG. 4, which is described in further detail below. Other at-bit parameters included in the bit-rock signature 222 can include a specific energy 226 of the subterranean formation, a drilling strength 228, etc. The processing device 202 can use the at-bit parameters of the bit-rock signature 222 to determine the bit condition 224, such as whether the drill bit is sharp, workable, dull, in need of cleaning, etc. In some examples, the computing device 101 may re-compute the bit-rock signature 222 and the bit condition 224 for every stand of the drilling operation. Thus, alerts or automatic adjustments to the drilling operation based on bit condition can be made in real time.

In some examples, the processing device 202 can use the bit condition 224 to generate a projected drilling distance 241. The projected drilling distance 241 can be a prediction of the future footage that can be drilled with a drill bit having the bit condition 224. The processing device 202 may generate the projected drilling distance 241 by estimating a drilling rate of a drill bit having the bit condition 224 (e.g., sharp, dull, etc.) and estimating a projected lifespan of the drill bit with the bit condition 224. The projected drilling distance 241 may then be calculated by determining the distance that a drill bit operating at the estimated drilling rate for the projected lifespan could drill. The processing device 202 may use the projected drilling distance 241 to determine adjustments to the drilling operation. For example, if the projected drilling distance 241 is above a predefined threshold, the drilling operation may continue. If the projected drilling distance 241 is below the predefined threshold, the processing device 202 may adjust some of the drilling operational parameters 220, such as adjusting surface WOB, surface RPMs, or ROP. Or, the processing device 202 may halt or terminate the drilling operation to switch to a newer drill bit.

Figure 3:
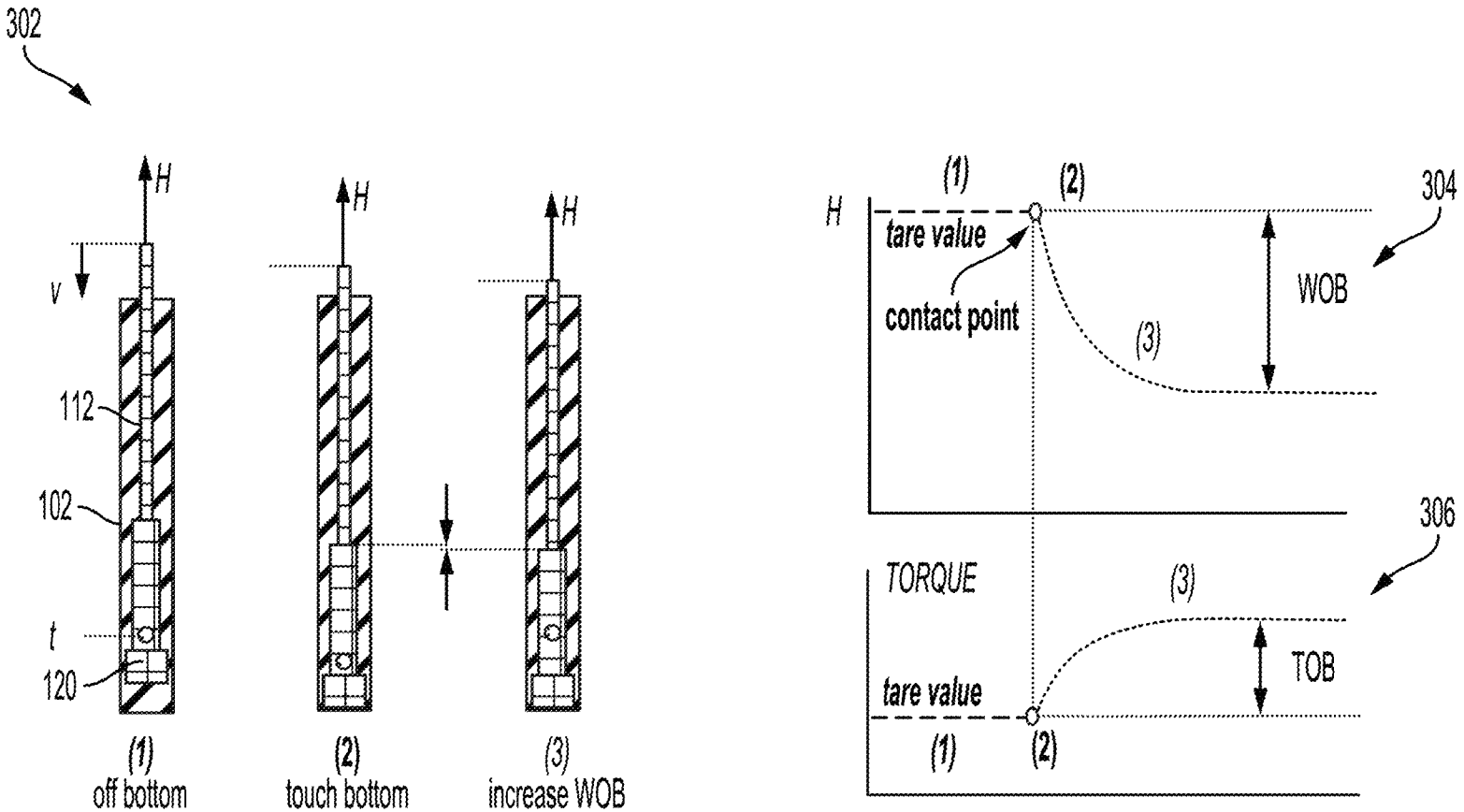
FIG. 3 depicts a downhole drilling system and graphs illustrating hook values of the drilling system, according to one example of the present disclosure.

FIG. 3 depicts a downhole drilling system 302 and graphs 304 and 306 illustrating hook values of the drilling system 302, according to one example of the present disclosure. The drilling system 302, including the drill string 112 and the drill bit 120, can be positioned downhole in the wellbore 102. In some examples, drilling of the wellbore may be calibrated (e.g., by computing device 101 of FIGS. 1-2) while tripping the drill string 112 downhole. For example, a set of coefficients may be applied to raw measurements of operational drilling parameters to correct for any spurious processes that may affect the measured variables, including sheave effect, hydraulic lift, hardening effect, RPM effect, top drive weight, etc. The sheave effect may be defined as the frictional loss in the sheave that leads to hysteresis effect on a hook load estimate. The hydraulic lift may be defined as the effect of drilling fluid or mud flow on the hook load due to buoyancy. The RPM effect may be defined as an effect of rotations per unit of time (e.g., RPMs) on off bottom torque. The top drive weight may be used for torque and drag simulation.

Such calibration may be performed during a tag bottom event of the drilling system 302. As shown in FIG. 3, at time 1 of the tag bottom event, the drilling system 302 may be "off bottom" (e.g., not contacting the bottom of the wellbore 102). At time 2, the drilling system 302 may touch bottom. The drilling system 302 may in some examples be lowered onto the bottom with drilling fluid flowing in the wellbore 102 and the drill string 112 rotating at a given steady RPM onto the bottom of the wellbore 102 to resume drilling. At time 3, the drill string 112 may increase WOB to begin drilling. As the drill bit 120 contacts the bottom of the wellbore 102, the WOB, TOB, and depth of cut may gradually increase, from which the bit-rock signature 222 can be determined.

Graph 304 includes a y-axis indicating hook load (e.g., weight of the drill string 112 and downhole tools, including drill bit 120) over an x-axis indicating time (e.g., including times 1, 2, and 3 shown for drilling system 302) during the tag bottom event. Graph 306 includes a y-axis indicating measured torque of the drill string 112 over an x-axis indicating time (e.g., including times 1, 2, and 3 shown for drilling system 302) during the tag bottom event. The computing device 101 of FIGS. 1-2 can use the hook load and torque of the drill string 112 (e.g., as measured by sensor 134 of FIG. 1 or sensor 214 of FIG. 2) to determine the at-bit weight on bit, torque on bit, depth of cut, and other parameters of the bit-rock signature 222. For example, the computing device 101 can determine a scaled weight on bit 236 $w=WOB/D$ and a scaled torque on bit 234 $t=TOB/D^2$, where D is the diameter of the bit, WOB is measured from graph 304, and TOB is measured from graph 306. The computing device 101 can also determine a drilling strength 228 $S=w/d$ and a specific energy 226 of the subterranean formation $E=t/d$, where d is the depth of cut.

FIG. 4 depicts graphs illustrating a bit-rock signature of a drilling system, according to one example of the present disclosure. Graph 402 depicts the TOB and WOB of the bit-rock signature divided into region I, region II, and region III. Region I can indicate inefficient drilling in the initial stages of a drilling operation, in which the TOB and/or WOB do not result in efficient drilling of a wellbore. Region II can indicate a range of TOB and WOB in which efficient drilling can be performed. Region III includes two possible branches-first branch 403*a* and second branch 403*b*. First branch 403*a* may have reduced slope compared to the slope of region II. Thus, the first branch 403*a* can indicate wear on the drill bit that is resulting in reduced TOB or WOB. Increasing the WOB may result in increasing ROP of the drill bit but may not result in the same drilling efficiency as in region II. The second branch 403*b* may have a downward slope indicating that increasing the WOB may not result in increasing TOB (and therefore ROP). This can be due to bit failure or a cleaning issue with the drill bit. For example, rock may be accumulating on the drill bit, causing resistance on the drill bit. Thus, the computing device 101 of FIG. 2 may determine a bit cleaning condition 240 indicating that the drill bit should be cleaned. The computing device 101 can transmit an alert indicating the bit cleaning condition 240. Additionally or alternatively, the computing device 101 can automatically adjust a flow rate of drilling fluid pumped downhole to flush the accumulated rock from the drill bit. In some examples, the computing device 101 may additionally or alternatively adjust the surface weight on bit, the surface RPMs, or other suitable drilling operational parameters for the drilling operation based on the bit cleaning condition 240 indicating that the drill bit should be cleaned. Other causes of deviation from the slope of region II may involve a change in subterranean formation, a drilling operational parameter change, system vibration caused by damage to the drill bit, and the like. The bit condition 224 can be determined based on changes in the t-w-d space.

Returning to FIG. 4, graph 404 and graph 406 depict the same bit-rock signature as graph 402. Graph 404 plots the TOB against the depth of cut (d) of the drill bit, and graph 406 plots the WOB against the depth of cut (including regions I, II, and III). For example, graph 404 The TOB, WOB, and depth of cut can be determined based on the drilling operational parameters 220 that are measured at the surface of the wellbore.

Figure 5:
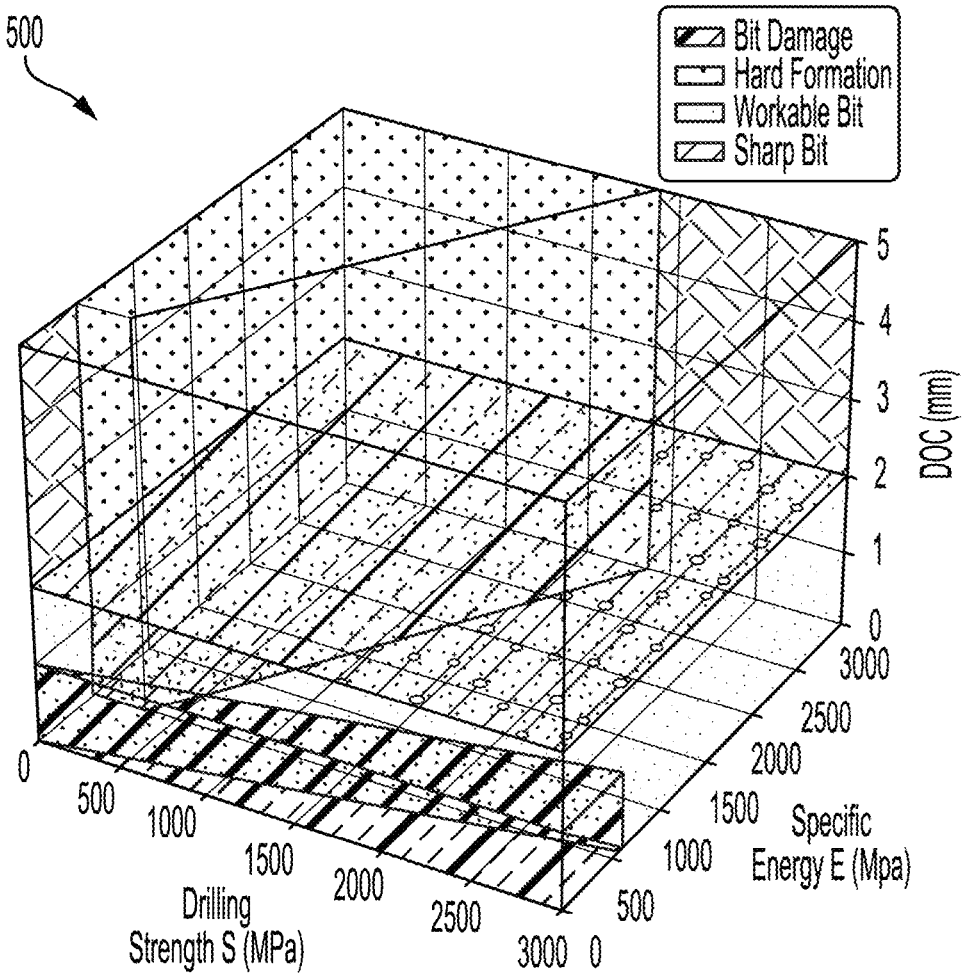
FIG. 5 depicts a graph illustrating spatial distribution of bit conditions of a drilling system, according to one example of the present disclosure.

FIG. 5 depicts a graph 500 illustrating spatial distribution of bit conditions of a drilling system, according to one example of the present disclosure. Different bit conditions of a drill bit can be determined based on parameters of a bit-rock signature 222, which can include specific energy 226 and drilling strength 228. The specific energy 226 can be defined as E=t/d and the drilling strength 228 can be defined as S=w/d. When the drill bit is in a relatively good condition (e.g., sharp or workable, not dull), E and S may have a relatively similar order of magnitude. When a drill bit is dull or otherwise damaged, S may increase faster than E.

The bit condition in some examples can be determined based on the correlation between S and E. For example, the computing device 101 of FIG. 2 may determine a correlation coefficient 230 between the specific energy 226 and the drilling strength 228. In one example, the Pearson correlation coefficient $r^2$ may be used:

$$r^2 = \frac{\sum SE - n\overline{S}\overline{E}}{\left[\sqrt{n\sum S^2 - (\sum S)^2}\right]\left[\sqrt{n\sum E^2 - (\sum E)^2}\right]}$$

In other examples, any other suitable correlation coefficient may be used. The computing device 101 may determine that the bit condition 224 indicates dullness or damage to the drill bit when the correlation coefficient 230 exceeds a predetermined threshold.

The spatial distribution illustrated in FIG. 5 may be as follows: the computing device 101 may categorize the drill bit as having a sharp bit condition when E>500, E/S>1.6, d>3 mm, and there is a hard formation (e.g., as indicated by a specific energy exceeding a predetermined threshold). The computing device 101 may categorize the drill bit as having a workable bit condition when 1 mm<d≤3 mm or d≤1 mm, and E/S≥0.2. The computing device 101 may categorize the drill bit as having a dull bit condition when d≤1 and E/S<0.2. The dull bit condition can include instances where the drill bit dulls slowly over time and when the drill bit suddenly becomes dull (e.g., due to contacting a hard formation). Other spatial distributions may also be used to determine bit condition of a drill bit.

Figure 6:
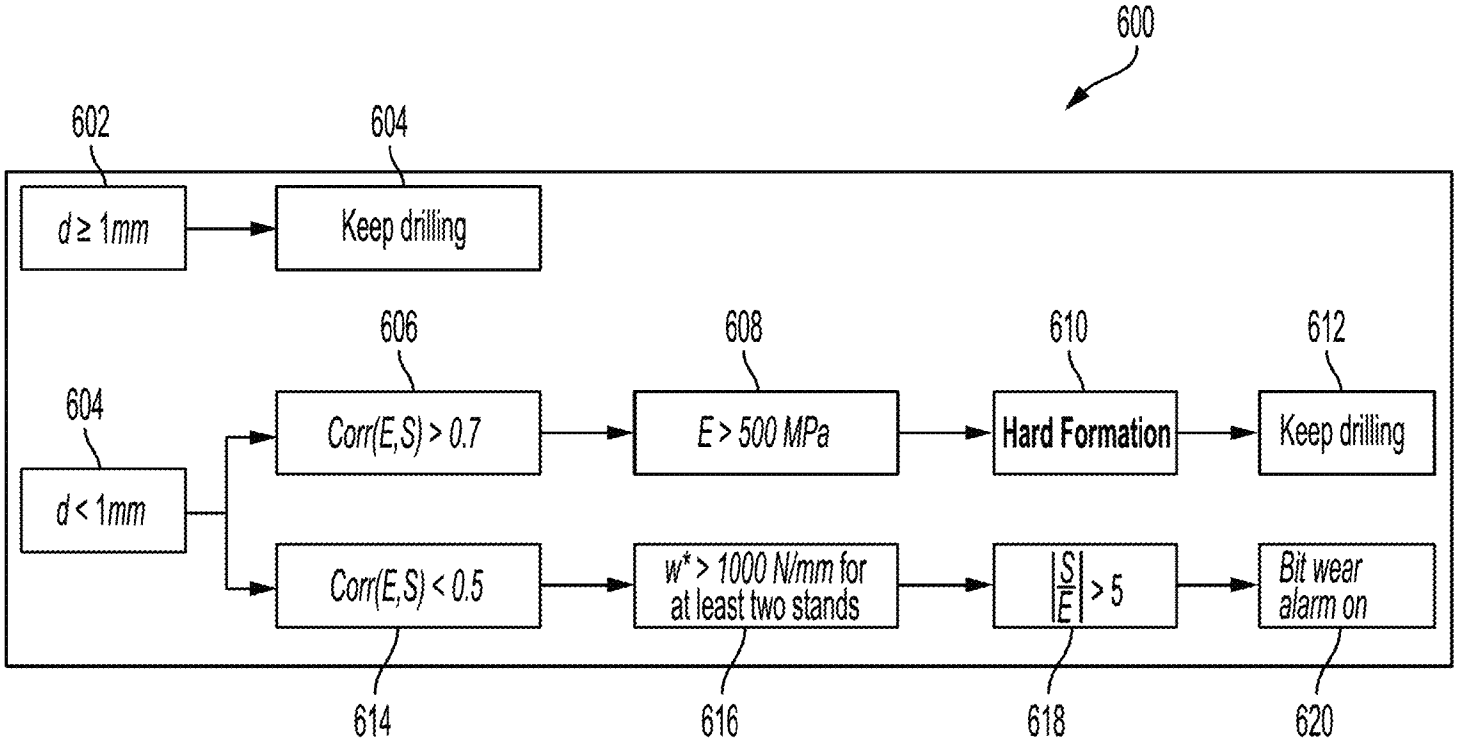
FIG. 6 illustrates a flow diagram for determining real-time bit wear detection of a drilling system, according to one example of the present disclosure.

FIG. 6 illustrates a flow diagram 600 for determining real-time bit wear detection of a drilling system, according to one example of the present disclosure. The operations of the flow diagram 600 can be performed based on parameters determined as part of a bit-rock signature for a drilling operation. At block 602, if the depth of cut is greater than or equal to 1 mm, the flow diagram can continue to block 604, in which the drilling operation continues. Having a depth of cut greater than or equal to 1 mm can indicate that the drilling operation is being performed efficiently with a sharp or workable bit.

At block 604, if the depth of cut is less than 1 mm, the flow diagram 600 can continue to block 606 or block 614. At block 606, the correlation coefficient between the specific energy E of the subterranean formation (which is not influenced by bit condition) and the drilling strength S may be greater than a first predefined threshold such as 0.7. Having a relatively high correlation coefficient that is greater than the first threshold may indicate that the drill bit is in a sharp or workable condition and that the drilling operation is proceeding at a relatively efficient rate.

At block 608, the specific energy of the subterranean formation may be greater than a second predefined threshold, such as 500 MPa. Thus, the flow diagram 600 may continue to block 610, wherein the subterranean formation is determined to have a hard formation based on the specific energy being greater than the second threshold. If some or all of the conditions in blocks 604, 606, 608, and 610 are met, the flow diagram continues to block 612, in which the drilling operation can continue, as the drill bit may be in a sharp or workable condition.

At block 614, the correlation coefficient between the specific energy E of the subterranean formation and the drilling strength S may be less than a third predefined threshold such as 0.5. Having a relatively low correlation coefficient may indicate that the drill bit is in a relatively dull condition. At block 616, the scaled weight on bit w may be greater than a fourth threshold, such as 1000 N/m, for at least two stands of the drilling operation. At block 618, the ratio of drilling strength to specific energy may be greater than a fifth threshold, such as 5. If some or all of the conditions in blocks 604, 614, 616, and 618 are met, the flow diagram continues to block 620, in which a bit wear alarm may be triggered (e.g., output to a wellbore operator. Additionally or alternatively, the drilling operation may be automatically terminated or halted, and in some examples, the drill string may be lifted out of the wellbore to replace the worn drill bit.

Figure 7:
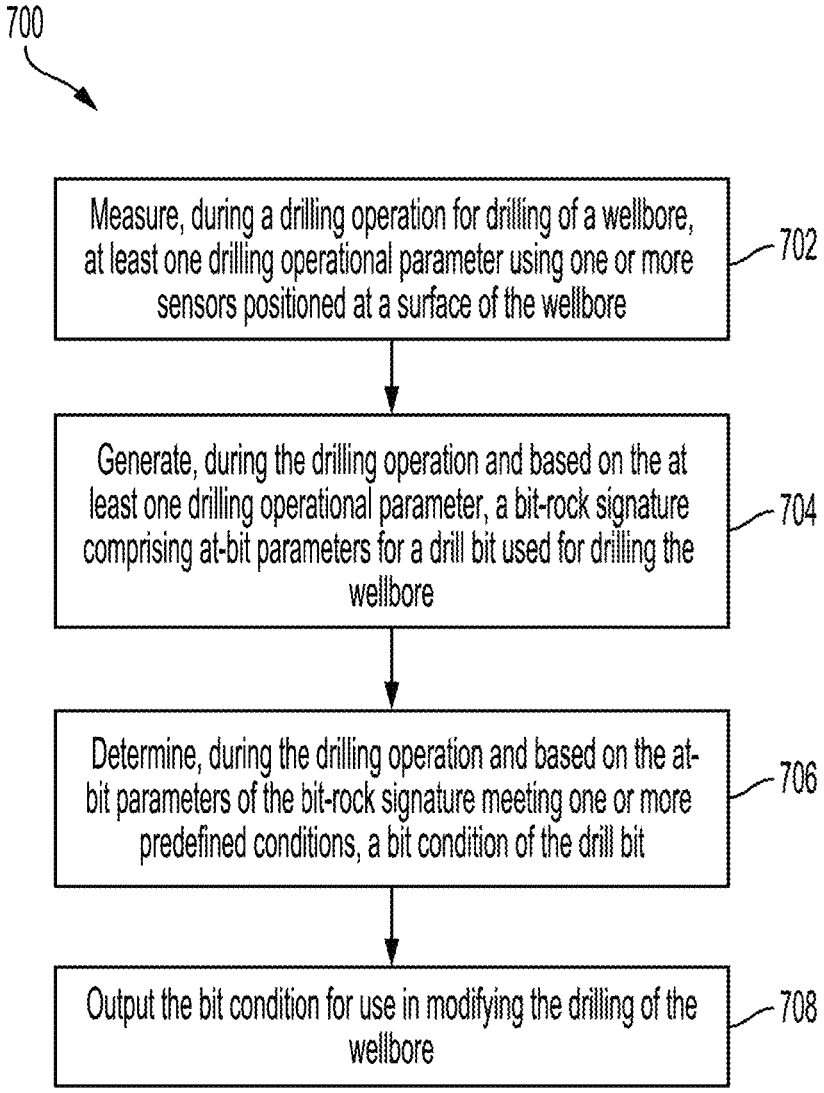
FIG. 7 illustrates a flow chart for determining real-time bit wear detection of a drilling system, according to one example of the present disclosure.

FIG. 7 illustrates an example flow chart 700 of a process for determining real-time bit wear detection of a drilling system, according to one example of the present disclosure. The steps of FIG. 7 can be performed by the processing device 202 of FIG. 2. Other examples can include more steps, fewer steps, different steps, or a different order of steps than is shown in FIG. 7. The steps of FIG. 7 are described below with reference to the components of FIGS. 1-6 above.

At block 702, the processing device 202 can measure, during a drilling operation for drilling of a wellbore 102, at least one drilling operational parameter 220 using one or more sensors 134 positioned at (e.g., disposed above) a surface of the wellbore 102. Examples of the drilling operational parameters 220 can include hook load (e.g., weight on the hook 124 on which a drill string 112 and downhole tools, including the drill bit 120, hang), surface rotations per minute (RPMs) of the drill string 112, flow rate of drilling fluid pumped into the wellbore 102, weight on bit at surface of the wellbore 102, or any other suitable parameter that is measured at the surface of the wellbore 102. The drilling operational parameters 220 may not include measurements taken downhole or at the drill bit.

At block 704, the processing device 202 can generate, based on the at least one drilling operational parameter 220, a bit-rock signature 222 comprising at-bit parameters for a drill bit 120 used for drilling the wellbore 102. The bit-rock signature 222 can be determined while the drilling operation is ongoing. The bit-rock signature 222 can indicate the drilling response of the drill bit 120 performing the drilling operation (e.g., drilling into the subterranean formation 104). For example, to determine the bit-rock signature 222, the processing device 202 can determine a specific energy 226 of the subterranean formation 104 based on the drilling operational parameters 220. The processing device 202 can also determine a drilling strength 228 of the drilling operation based on the drilling operational parameters 220. The specific energy 226 and the drilling strength 228 can be determined from a depth of cut 232, a torque on bit 234, and a weight on bit 236. Each of the depth of cut 232, torque on bit 234, and weight on bit 236 (or any other at-bit parameters) can be determined from the drilling operational parameters 220, such as by graphing a hook load of the drill string 112 during a tag bottom event over time.

At block 706, the processing device 202 can determine, based on the at-bit parameters of the bit-rock signature 222 meeting one or more predefined conditions, a bit condition 224 of the drill bit 120. The bit condition 224 can be determined while the drilling operation is ongoing. Example bit conditions 224 can include a sharp condition, a workable condition, or a dull condition. A drill bit 120 with a dull condition may be incapable or otherwise inefficient in drilling the wellbore 102. In some cases, a drill bit 120 with a dull condition may cause damage to other downhole tools, such as by causing vibration in the tool string. The processing device 202 may determine that the drill bit 120 has a dull condition by determining that a value of one or more of the parameters included in the bit-rock signature 222 satisfies a predefined condition. For example, if a correlation coefficient 230 for the specific energy 226 and drilling strength 228 falls below a predefined value, the processing device 202 may determine that the drill bit 120 has a dull condition. Or, if one or more of the depth of cut 232, the torque on bit 234, or the weight on bit 236 have values that meet predefined conditions, the processing device 202 may determine that the drill bit 120 has a dull condition.

In some examples, the bit condition 2234 may include a bit cleaning condition 240. For example, the processing device 202 may determine, based on at least in part on one of the values of the depth of cut 232, the torque on bit 234, or the weight on bit 236, a bit cleaning condition 240 indicating that the drill bit 120 needs cleaning due to accumulated rock. The accumulated rock may be preventing the drill bit 120 from drilling at a desired ROP. Other conditions of the drill bit 120 may also be determined based on the bit-rock signature 222.

At block 708, the processing device 202 can output the bit condition 224 for use in modifying the drilling of the wellbore 102. The bit condition 224 can be output while the drilling operation is ongoing, so that real time adjustments can be made to the drilling operation. For example, if the bit condition 224 indicates that the drill bit 120 is dull or damaged, the processing device 202 can output an alert to a wellbore operator. Additionally or alternatively, the processing device 202 can automatically terminate, halt, or modify the drilling operation. For example, the processing device 202 may automatically adjust a weight on bit of the drill bit 120 based on the bit condition 224, such increasing the surface weight on bit if the slope of measured torque on bit 234 over weight on bit 236 has decreased but still has a positive value. In another example where the bit condition 224 indicates accumulated rock on the drill bit 120, the processing device 202 can automatically increase a flow rate of drilling fluid pumped into the wellbore 102. The increased drilling fluid can flush the accumulated rock off the drill bit 120, thus enabling the drill bit 120 increase ROP. Additionally or alternatively, the processing device 202 can adjust the surface weight on bit or the surface RPM to remove the accumulated rock off the drill bit 120.

In some aspects, system, method, and computer-readable medium for real-time bit wear detection based on surface data are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processing device; and a memory device that includes instructions executable by the processing device for causing the processing device to: measure, during a drilling operation for drilling of a wellbore, at least one drilling operational parameter using one or more sensors positioned at a surface of an operating rig for the wellbore; generate, during the drilling operation and based on the at least one drilling operational parameter, a bit-rock signature comprising at-bit parameters for a drill bit used for drilling the wellbore; determine, during the drilling operation and based on the at-bit parameters of the bit-rock signature meeting one or more predefined conditions, a bit condition of the drill bit; and output the bit condition for use in modifying the drilling of the wellbore.

Example 2 is the system of example(s) 1, wherein the memory device further includes instructions executable by the processing device for causing the processing device to: generate a projected drilling distance for the drill bit based on the bit condition of the drill bit; and adjust the drilling operation based on the projected drilling distance.

Example 3 is the system of any of example(s) 1-2, wherein the memory device further includes instructions executable by the processing device for causing the processing device to: generate the bit-rock signature by determining, based on the at least one drilling operational parameter: a torque on bit for the drill bit; a depth of cut of a subterranean formation that is drilled by the drill bit; and a weight on bit for the drill bit; and determine the bit condition of the drill bit by determining that a value of at least one of the depth of cut, the torque on bit, and the weight on bit satisfy a predefined condition.

Example 4 is the system of any of example(s) 1-3, wherein the memory device further includes instructions executable by the processing device for causing the processing device to: determine, based at least in part on the at least one drilling operational parameter, the bit condition by determining a bit cleaning condition; and automatically adjust, based on the bit cleaning condition, a flow rate of a drilling fluid flowing in the wellbore, a weight on bit, or a surface rotations per minute (RPM) for the drilling operation.

Example 5 is the system of any of example(s) 1-4, wherein the bit condition comprises at least one of a sharp condition, a workable condition, or a dull condition.

Example 6 is the system of any of example(s) 1-5, wherein the memory device further includes instructions executable by the processing device for causing the processing device to: generate the bit-rock signature by determining, based on the at least one drilling operational parameter, a specific energy of a subterranean formation and a drilling strength at the drill bit; determine a correlation coefficient between the specific energy and the drilling strength; and determine the bit condition of the drill bit based on the correlation coefficient.

Example 7 is the system of any of example(s) 1-6, wherein the memory device further includes instructions executable by the processing device for causing the processing device to: automatically output an alarm or halt the drilling operation in the wellbore based on the bit condition.

Example 8 is a method comprising: measuring, by a processing device, at least one drilling operational parameter during a drilling operation for drilling of a wellbore using one or more sensors positioned at a surface of an operating rig for the wellbore; generating, by the processing device during the drilling operation and based on the at least one drilling operational parameter, a bit-rock signature comprising at-bit parameters for at a drill bit used for drilling the wellbore; determining, by the processing device during the drilling operation and based on the at-bit parameters of the bit-rock signature meeting one or more predefined conditions, a bit condition of the drill bit; and outputting, by the processing device, the bit condition for use in modifying the drilling of the wellbore.

Example 9 is the method of example(s) 8, further comprising: generating the bit-rock signature by determining, based on the at least one drilling operational parameter: a torque on bit for the drill bit; a depth of cut of a subterranean formation that is drilled by the drill bit; and a weight on bit for the drill bit; and determining the bit condition of the drill bit by determining that a value of at least one of the depth of cut, the torque on bit, and the weight on bit satisfy a predefined condition.

Example 10 is the method of any of example(s) 8-9, further comprising: determining, based at least in part on the at least one drilling operational parameter, the bit condition by determining a bit cleaning condition; and automatically adjusting, based on the bit cleaning condition, a flow rate of a drilling fluid flowing, weight on bit and surface RPM in the wellbore.

Example 11 is the method of any of example(s) 8-10, wherein the bit condition comprises at least one of a sharp condition, a workable condition, or a dull condition.

Example 12 is the method of any of example(s) 8-11, further comprising: generating the bit-rock signature by determining, based on the at least one drilling operational parameter, a specific energy of a subterranean formation and a drilling strength at the drill bit; determining a correlation coefficient between the specific energy and the drilling strength; and determining the bit condition of the drill bit based on the correlation coefficient.

Example 13 is the method of any of example(s) 8-12, further comprising: automatically output an alarm or halt the drilling operation in the wellbore based on the bit condition.

Example 14 is a non-transitory computer-readable medium comprising program code that is executable by a processing device for causing the processing device to: measure, during a drilling operation for drilling of a wellbore, at least one drilling operational parameter using one or more sensors positioned at a surface of the wellbore; generate, during the drilling operation and based on the at least one drilling operational parameter, a bit-rock signature comprising at-bit parameters for a drill bit used for drilling the wellbore; determine, during the drilling operation and based on the at-bit parameters of the bit-rock signature meeting one or more predefined conditions, a bit condition of the drill bit; and output the bit condition for use in modifying the drilling of the wellbore.

Example 15 is the non-transitory computer-readable medium of example(s) 14, wherein the program code is further executable by the processing device for causing the processing device to: generate the bit-rock signature by determining, based on the at least one drilling operational parameter, a specific energy of a subterranean formation and a drilling strength at the drill bit; determine a correlation coefficient between the specific energy and the drilling strength; and determine the bit condition of the drill bit based on the correlation coefficient.

Example 16 is the non-transitory computer-readable medium of any of example(s) 14-15, wherein the program code is further executable by the processing device for causing the processing device to: generate the bit-rock signature by determining, based on the at least one drilling operational parameter: a torque on bit for the drill bit; a depth of cut of a subterranean formation that is drilled by the drill bit; and a weight on bit for the drill bit; and determine the bit condition of the drill bit by determining that a value of at least one of the depth of cut, the torque on bit, and the weight on bit satisfy a predefined condition.

Example 17 is the non-transitory computer-readable medium of any of example(s) 14-16, wherein the program code is further executable by the processing device for causing the processing device to: determine, based at least in part on the at least one drilling operational parameter, the bit condition by determining a bit cleaning condition; and automatically adjust, based on the bit cleaning condition, a flow rate of a drilling fluid flowing in the wellbore, a surface rotations per minute (RPM), and a weight on bit for the drilling operation.

Example 18 is the non-transitory computer-readable medium of any of example(s) 14-17, wherein the bit condition comprises at least one of a sharp condition, a workable condition, or a dull condition.

Example 19 is the non-transitory computer-readable medium of any of example(s) 14-18, wherein the program code is further executable by the processing device for causing the processing device to: automatically output an alarm or halt the drilling operation in the wellbore based on the bit condition.

Example 20 is the non-transitory computer-readable medium of any of example(s) 14-19, wherein the program code is further executable by the processing device for causing the processing device to: generate a projected drilling distance for the drill bit based on the bit condition of the drill bit; and adjust the drilling operation based on the projected drilling distance.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processing device; and a memory device that includes instructions executable by the processing device for causing the processing device to:

measure, during a drilling operation for drilling of a wellbore, at least one drilling operational parameter using one or more sensors positioned at a surface of an operating rig for the wellbore;

determine, during the drilling operation and based on the at least one drilling operational parameter, a specific energy of a subterranean formation and a drilling strength of a drill bit;

determine a correlation coefficient between the specific energy and the drilling strength; and automatically adjust the drilling operation by (i) increasing at least one parameter of a drill string in response to determining that the correlation coefficient is below a predetermined threshold or (ii)

decreasing the at least one parameter of the drill string in response to determining that the correlation coefficient is above the predetermined threshold, wherein the at least one parameter includes weight on bit, rotations per minute, or flow rate.

2. The system of claim 1, wherein the memory device further includes instructions executable by the processing device for causing the processing device to:

determine, based on the correlation coefficient, a bit condition of the drill bit;

generate a projected drilling distance for the drill bit based on the bit condition of the drill bit; and adjust the drilling operation based on the projected drilling distance.

3. The system of claim 1, wherein the memory device further includes instructions executable by the processing device for causing the processing device to:

generate a bit-rock signature by determining, based on the at least one drilling operational parameter:

a torque on bit for the drill bit;

a depth of cut of the subterranean formation that is drilled by the drill bit; and the weight on bit for the drill bit; and determine a bit condition of the drill bit by determining that a value of at least one of the depth of cut, the torque on bit, and the weight on bit satisfy a predefined condition.

4. The system of claim 1, wherein the memory device further includes instructions executable by the processing device for causing the processing device to:

determine, based on the correlation coefficient, a bit cleaning condition of the drill bit; and automatically adjust, based on the bit cleaning condition, the flow rate of a drilling fluid flowing in the wellbore, the weight on bit, or the rotations per minute (RPM) for the drilling operation.

5. The system of claim 1, wherein the memory device further includes instructions executable by the processing device for causing the processing device to:

determine, based on the correlation coefficient, a bit condition of the drill bit comprising at least one of a sharp condition, a workable condition, or a dull condition.

6. The system of claim 1, wherein the memory device further includes instructions executable by the processing device for causing the processing device to:

automatically output an alarm or halt the drilling operation in the wellbore based on the correlation coefficient.

7. The system of claim 1, wherein the memory device further includes instructions that are executable by the processing device for causing the processing device to:

determine the drilling strength based on a surface weight on bit and a depth of cut for the drilling operation.

8. The system of claim 1, wherein the memory device further includes instructions that are executable by the processing device for causing the processing device to:

determine the specific energy based on a surface torque on bit and a depth of cut for the drilling operation.

9. The system of claim 1, wherein the memory device further includes instructions that are executable by the processing device for causing the processing device to measure the at least one drilling operational parameter subsequent to a tag bottom event occurring for the drill bit.

10. A method comprising:

measuring, by a processing device, at least one drilling operational parameter during a drilling operation for drilling of a wellbore using one or more sensors positioned at a surface of an operating rig for the wellbore;

determining, by the processing device and based on the at least one drilling operational parameter, a specific energy of a subterranean formation and a drilling strength of a drill bit;

determining, by the processing device, a correlation coefficient between the specific energy and the drilling strength; and automatically adjusting, by the processing device, the drilling operation by (i) increasing at least one parameter of a drill string in response to determining that the correlation coefficient is below a predetermined threshold or (ii) decreasing the at least one parameter of the drill string in response to determining that the correlation coefficient is above the predetermined threshold, wherein the at least one parameter includes weight on bit, rotations per minute, or flow rate.

11. The method of claim 10, further comprising:

generating a bit-rock signature by determining, based on the at least one drilling operational parameter:

a torque on bit for the drill bit;

a depth of cut of the subterranean formation that is drilled by the drill bit; and the weight on bit for the drill bit; and determining a bit condition of the drill bit by determining that a value of at least one of the depth of cut, the torque on bit, and the weight on bit satisfy a predefined condition.

12. The method of claim 10, further comprising:

determining, based on the correlation coefficient, a bit cleaning condition of the drill bit; and automatically adjusting, based on the bit cleaning condition, the flow rate of a drilling fluid flowing in the wellbore, the weight on bit, and the rotations per minute (RPM) for the drilling operation.

13. The method of claim 10, further comprising:

determining, based on the correlation coefficient, a bit condition of the drill bit comprising at least one of a sharp condition, a workable condition, or a dull condition.

14. The method of claim 10, further comprising:

automatically outputting an alarm or halt the drilling operation in the wellbore based on the correlation coefficient.

15. A non-transitory computer-readable medium comprising program code that is executable by a processing device for causing the processing device to:

measure, during a drilling operation for drilling of a wellbore, at least one drilling operational parameter using one or more sensors positioned at a surface of the wellbore;

determine, based on the at least one drilling operational parameter, a specific energy of a subterranean formation and a drilling strength of a drill bit;

determine a correlation coefficient between the specific energy and the drilling strength; and automatically adjust the drilling operation by (i) increasing at least one parameter of a drill string in response to determining that the correlation coefficient is below a predetermined threshold or (ii) decreasing the at least one parameter of the drill string in response to determining that the correlation coefficient is above the predetermined threshold, wherein the at least one parameter includes weight on bit, rotations per minute, or flow rate.

16. The non-transitory computer-readable medium of claim 15, wherein the program code is further executable by the processing device for causing the processing device to:

generate a bit-rock signature by determining, based on the at least one drilling operational parameter:

a torque on bit for the drill bit;

a depth of cut of the subterranean formation that is drilled by the drill bit; and the weight on bit for the drill bit; and determine a bit condition of the drill bit by determining that a value of at least one of the depth of cut, the torque on bit, and the weight on bit satisfy a predefined condition.

17. The non-transitory computer-readable medium of claim 15, wherein the program code is further executable by the processing device for causing the processing device to:

determine, based on the correlation coefficient, a bit cleaning condition of the drill bit; and automatically adjust, based on the bit cleaning condition, the flow rate of a drilling fluid flowing in the wellbore, the rotations per minute (RPM), and the weight on bit for the drilling operation.

18. The non-transitory computer-readable medium of claim 15, wherein the program code is further executable by the processing device for causing the processing device to:

determine, based on the correlation coefficient, a bit condition of the drill bit, wherein the bit condition comprises at least one of a sharp condition, a workable condition, or a dull condition.

19. The non-transitory computer-readable medium of claim 18, wherein the program code is further executable by the processing device for causing the processing device to:

automatically output an alarm or halt the drilling operation in the wellbore based on the bit condition.

20. The non-transitory computer-readable medium of claim 18, wherein the program code is further executable by the processing device for causing the processing device to:

generate a projected drilling distance for the drill bit based on the bit condition of the drill bit; and adjust the drilling operation based on the projected drilling distance.

* * * * *